US005423586A

United States Patent [19]

Fuller

[11] Patent Number: 5,423,586

[45] Date of Patent: Jun. 13, 1995

[54] TANK TOTE

[75] Inventor: Mark A. Fuller, Graham, N.C.

[73] Assignee: Fuller Specialties, Inc., Burlington, N.C.

[21] Appl. No.: 125,191

[22] Filed: Sep. 23, 1993

[51] Int. Cl.[6] ..... A45C 13/26; B65D 30/06

[52] U.S. Cl. ..... 294/149; 383/6; 383/117

[58] Field of Search ..... 294/31.2, 137, 141, 294/142, 147, 149–157, 165; 150/154; 206/315.1, 446; 220/694, 724, 737, 752, 754, 758, 759; 224/202, 205, 209, 214, 250, 259, 262; 383/6, 7, 12, 13, 16, 17, 72, 117; 405/185, 186

[56] References Cited

U.S. PATENT DOCUMENTS

| | | | |
|---|---|---|---|
| 2,495,391 | 1/1950 | Smith | 383/6 X |
| 2,982,105 | 5/1961 | Akers | 224/202 X |
| 3,105,359 | 10/1963 | Ellis | 224/202 X |
| 3,132,390 | 5/1964 | Boden . | |
| 3,135,098 | 6/1964 | Root | 224/202 X |
| 3,599,690 | 8/1971 | Christie | 383/72 X |
| 3,921,872 | 11/1975 | Buell, Jr. . | |
| 4,062,392 | 12/1977 | Ishii | 383/16 X |
| 4,102,019 | 7/1978 | Boden . | |
| 4,109,692 | 8/1978 | Brown | 220/724 X |
| 4,310,110 | 1/1982 | Dexter . | |
| 4,438,764 | 3/1984 | Eppolito | 224/259 X |
| 4,775,082 | 10/1988 | Krache . | |
| 4,804,218 | 2/1989 | Hilliard | 294/157 X |
| 5,050,999 | 9/1991 | Van Loon | 383/6 X |

FOREIGN PATENT DOCUMENTS

| | | | |
|---|---|---|---|
| 2592628 | 7/1987 | France | 405/186 |

*Primary Examiner*—Johnny D. Cherry
*Attorney, Agent, or Firm*—Rhodes, Coats & Bennett

[57] ABSTRACT

A carrier for a scuba tank having a nipple end and a bottom end and being of a specific size includes a porous fabric bag open at one end and sized to be snugly fitted onto the scuba tank from over the bottom end of the scuba tank. A closure for the open end of the bag permits selective opening and closing of the open end, and a strap has a first portion sewn to the bag and in encircling relation to at least a portion of the bag and a handle portion. The fabric bag can be snugly fitted onto the scuba tank from over the bottom end of the scuba tank, the open end of the bag can be closed by the closure and the combined scuba tank and bag may be conveniently carried using the strap handle portion as a handle, with the first portion of the strap providing support for the tank.

9 Claims, 2 Drawing Sheets

TANK TOTE

BACKGROUND OF THE INVENTION

The present invention relates to improvements in carriers for scuba diving tanks and other, similar tanks.

In the art of scuba diving, a diver wears a generally cylindrically-shaped tank of compressed air on his or her back while submerged under water. The compressed air has an outlet through a nipple end of the tank, a regulator and a, hose to provide air to the diver to breath while under water.

When the tank is depleted of the compressed air, it is conventional to refill the tank through an air compressor facility which may or may not be conveniently near the dive site. Accordingly, it is often necessary to transport the tanks from one place to another for use, for filling and for storage.

Heretofore, efforts have been made to provide devices to assist in carrying scuba tanks, as shown in U.S. Pat. No. 3,921,872 to Buell, Jr., which discloses a gas cylinder carrier of a rigid material so that it serves as a piece of luggage for the cylinder. Also, U.S. Pat. No. 4,804,218 to Hilliard discloses a scuba tank harness which is clamped to the tank transport and removed when diving. However, the prior art tank carriers add expense and complications to the tank carrying function. For example, in both of the two above-mentioned patents, when the tanks are delivered to the dive site, the devices must be removed from the tank before it can be used. This adds an additional complication to preparing for a dive. Also, during the dive, the carrying devices must be stored, and if the dive is from a boat, this can be a problem because space is at a premium. Furthermore, the devices shown in the two above-mentioned patents both appear to be expensive to fabricate.

Accordingly, there is a need in the art for an inexpensive, convenient carrier for scuba tanks.

SUMMARY OF THE INVENTION

The present invention fulfills this need in the art by providing a carrier for a scuba tank having a nipple end and a bottom end and being of a specific size. The carrier includes a porous fabric bag open at one end and sized to be snugly fitted onto the scuba tank from over the bottom end of the scuba tank. A closure for the open end of the bag permits selective opening and closing of the open end. A strap has a first portion sewn to the bag and in encircling relation to part of the bag and a handle portion. The bag can be snugly fitted onto the scuba tank from over the bottom end of the scuba tank, the open end of the bag can be closed by the closure and the combined scuba tank and bag may be conveniently carried using the strap handle portion as a handle, with the first portion of the strap providing support for the tank.

In a preferred embodiment the fabric is a raschel warp knit mesh fabric that has been heat set to remove most of its stretch. The bag may be of a size to fit on a tank of a size selected from the group consisting of 50CF, 63CF, 80CF, 10 liter, 12 liter and 15 liter, or any other scuba tank size. The closure may be a drawstring closure.

Preferably, the strap is a single strap having a first end sewn to the bag, a first continuation forming a first handle loop, a second continuation sewn to and partially encircling the bag, a third continuation forming a second handle loop, and a fourth continuation sewn to and partially encircling the bag and substantially meeting the first end. Thus, the strap forms a saddle supporting the carried tank. Desirably, the strap is sewn to the bag at stress points with a box X stitch.

The invention also provides a scuba diving assembly including a scuba tank having a nipple end and a bottom end and being of a specific size and a carrier for the scuba tank. The carrier is as described above.

The invention also provides a method of carrying a scuba tank having a nipple end and a bottom end and being of a specific size. The method includes snugly fitting a porous fabric bag that has an attached strap with a portion at least partially encircling the bag and a handle portion over the bottom end of the scuba tank. Then the open end of the bag is closed, and the bag and scuba tank combination is picked up by the handle portion of the strap with the partially encircling portion supporting the scuba tank.

The method may also include folding the handle portion onto the bag and mounting the bag and scuba tank combination on a scuba tank harness, with the handle portions restrained from movement by binders on the harness. The method may also include wearing the bag and scuba tank combination while scuba diving.

BRIEF DESCRIPTION OF THE DRAWINGS

The invention will be better understood after a reading of the detailed description of a preferred embodiment and a study of the drawing in which.

DETAILED DESCRIPTION OF A PREFERRED EMBODIMENT

Figure 1:
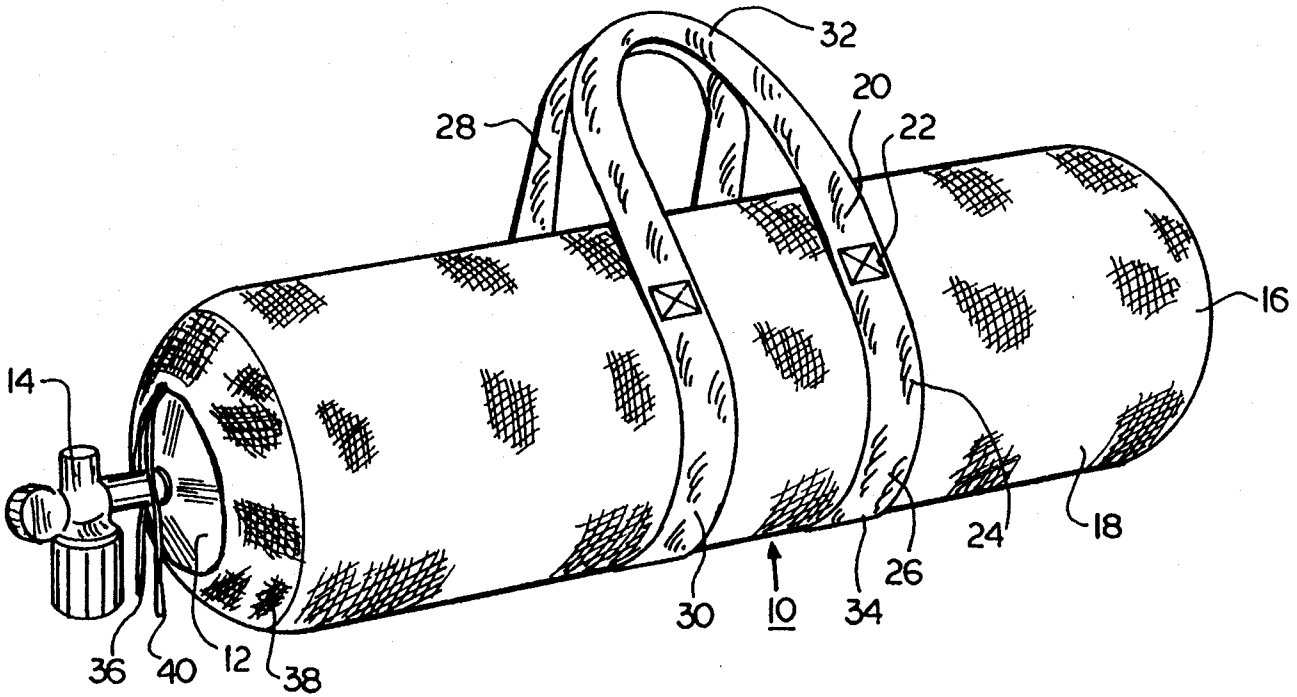
FIG. 1 is a perspective view of a scuba tank equipped with a carrier according to an embodiment of the invention.

Referring now to FIG. 1, there is shown a tank carrier 10 mounted on and equipped for carrying a tank 12. As can be seen, the tank 12 has a nipple end 14 provided with a regulator attachment through which air can be withdrawn at a controlled rate for breathing.

The carrier 10 is largely made up of a porous fabric bag 16. The bag 16 is sized to snugly fit on the tank 12. Thus, various sizes of bags are desirable to fit on various sizes of scuba tanks. Currently, the standard scuba tank sizes are 50 cubic feet, 63 cubic feet, 80 cubic feet and 100 cubic feet as well as 10 liters, 12 liters and 15 liters. The sizing of the bag to match the tank size so as to get a snug fit can be carried out in a straight forward fashion.

Preferably, the bag is made of a raschel warp-knit, mesh fabric. The fibers are preferably polyester, although other materials could be used. The preferred knit is a 3-bar construction. Alternate fabrics can be substituted, such as tricot and the like. Preferably, the fabric is heat-set so as to be dimensionally stable and unlikely to stretch. This will assure that the fabric will maintain its snug fit on the tank even during repeated wettings and dryings, to which the tank 12 and fabric bag 16 will be exposed.

Attached to the bag is a strap 20, preferably of one piece, although other constructions could be substituted. The one piece strap 20 is sewn to the bag beginning at a first end 26 which, in the view of the figure, begins as seen and passes under the bag and cylinder to partially encircle the bag and cylinder. As seen in the Figure, the strap emerges to form a handle portion 28 which turns back down in the view of the Figure to form a continuation portion 30 which partially encircles the bag and cylinder. A further continuation extends up to form another handle portion 32, terminating in a final end portion 24 abutting the first end 26. The strap is sewn to the fabric all along its length, with extra stitching in the form of box-X stitches 22 at stress points. The stress points are the points along the strap where the stitching ends. The box-X stitch provides a stronger bond to the fabric. Preferably, the ends 24 and 26 are overlapped. The strap 20, as can be seen, is affixed to the bag 16 midway along its length, so that when the handles are being used to carry a cylinder, the load will be balanced.

The open end of the bag 16 is provided with a draw string closure 36 formed in a hem in a typical draw string formation. The draw string may be cinched shut by a clamp 40. Preferably, the clamp is as shown in one or more of U.S. Pat. Nos. 3,132,390 to Boden or 4,102,019 to Boden, the entire disclosures of both of which are hereby incorporated herein by reference.

Figure 2:
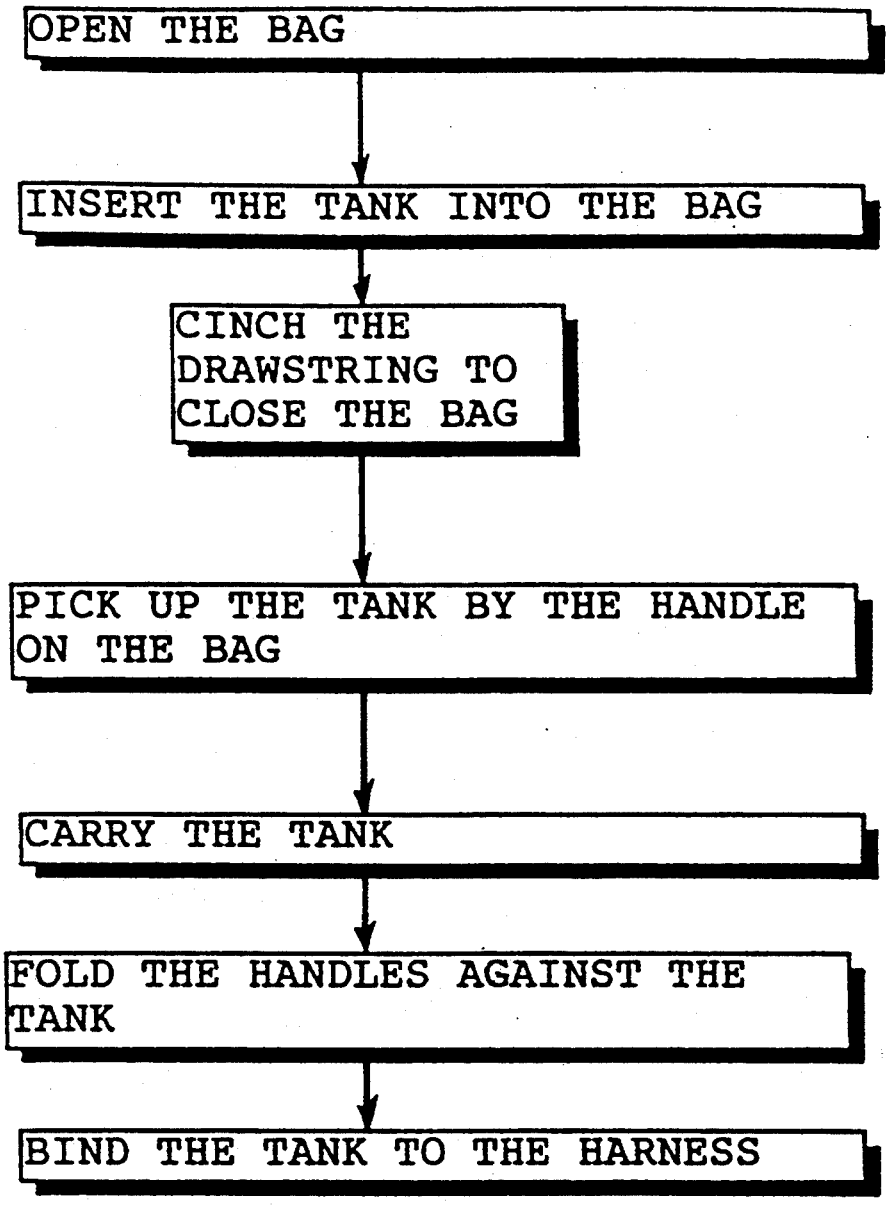
FIG. 2 is a schematic flow chart of the method of use of the tank carrier

In use as seen in FIG. 2, the carrier 16 can be easily affixed to the tank 12. First, the draw string is opened and then the bottom end 18 of the tank is inserted into the bag, with the tank being inserted as far as it will go. The size of the bag is such that the tank will be contained snugly. The tank can be held in the bag by cinching shut the draw string 36 and clamping it shut with the clamp 40.

Then, the tank and carrier can be picked up merely by grasping the handle portions 28 and 32 and carrying the tank. As can be seen, the remainder of the strap forms a supporting saddle to hold the weight of the tank.

When it comes time to make a dive, the bag need not be removed from the tank. Instead, the handle portions 28 and 32 are folded up against the outer portion of the bag 16 and the tank can be strapped onto a harness in conventional fashion, such as a conventional buoyancy compensator. The straps will thus be out of the way, tucked between the tank and the buoyancy compensator. The dive can then take place. Since the fabric bag 16 is porous and, preferably of polyester, which is hydrophobic, it will dry quickly after the dive. Water will not be trapped in the bag because the porous mesh will let the water drain out. Also, sand or dirt will not get trapped in the bag due to its porosity.

The bag will also serve as a protector for the tank keeping the tanks free of nicks and bumps.

Preferably, the straps are polypropylene.

Providing the bag of a tight fit also helps to keep foreign matter and debris from coming between the bag and the tank.

Thus, the carrier can stay on the tank indefinitely, throughout many cycles of dives, refillings and storage and the transportation between them.

The present invention may, of course, be carried out in other specific ways than those herein set forth without departing from the spirit and essential characteristics of the invention. The present embodiments are, therefore, to be considered in all respects as illustrative and not restrictive and all changes coming within the meaning and equivalency range of the appended claims are intended to be embraced therein.

What is claimed is:

1. A carrier for a scuba tank having a nipple end and a bottom end and being of a specific size comprising a porous bag made of a raschel wrap knit mesh fabric that has been heat set to remove most of its stretch, said bag being open at one end and sized to be snugly fitted onto the scuba tank from over the bottom end of the scuba tank, and a strap having a first portion sewn to said bag and in encircling relation to at least a portion of said bag and a handle portion, whereby said fabric bag can be snugly fitted onto the scuba tank from over the bottom end of the scuba tank and the combined scuba tank and bag may be conveniently carried using the strap handle portion as a handle, with said first portion of said strap providing support for the tank.

2. A carrier as claimed in claim 1 wherein said bag is sized to fit on a tank of a size selected from the group consisting of 50 CF, 63 CF, 80 CF, 10 liter, 12 liter and 15 liter.

3. A carrier as claimed in claim 1 further comprising a drawstring closure for said open end of said bag.

4. A carrier as claimed in claim 1 wherein said strap is a single strap having a first end sewn to said bag, a first continuation forming a first handle loop, a second continuation sewn to and partially encircling said bag, a third continuation forming a second handle loop, and a fourth continuation sewn to and partially encircling said bag and substantially meeting said first end, whereby said strap forms a saddle supporting the carried tank.

5. A carrier as claimed in claim 1 wherein said strap is sewn to said bag at stress points with a box X stitch.

6. A carrier for a scuba tank having a nipple end and a bottom end and being of a size selected from the group consisting of 50 CF, 63 CF, 80 CF, 10 liter, 12 liter and 15 liter, comprising a. a bag open at one end and sized to be snugly fitted onto the scuba tank over the bottom end of the scuba tank and of a porous, raschel warp knit mesh fabric that has been heat set to have very little stretch, b. a drawstring closure for said open end of said bag to permit selective opening and closing of said open end, and c. a strap having 1) a first end sewn to said bag, 2) a first continuation forming a first handle loop, 3) a second continuation sewn to and partially encircling said bag, 4) a third continuation forming a second handle loop, and 5) a fourth continuation sewn to and partially encircling said bag and substantially meeting said first end, whereby said fabric bag can be snugly fitted onto the scuba tank from over the bottom end of the scuba tank, the open end of the bag can be closed by the closure and the combined scuba tank and bag can be conveniently carried using the first and third continuations of said strap as a handle, with said first end and said second and fourth continuations of said strap providing saddle support for the tank.

7. A scuba diving assembly comprising:

a. a scuba tank having a nipple end and a bottom end and being of a specific size and b. a carrier for said scuba tank including 1) a porous bag made of a raschel wrap knit mesh fabric that has been heat set to remove most of its stretch, said bag being open at one end and snugly fitted onto said scuba tank with said open end adjacent said nipple end of said tank, and 2) a strap having a first portion sewn to said bag and in encircling relation to at least a portion of said bag and a handle portion of said bag and a handle portion, whereby the combined scuba tank and bag may be conveniently carried using the strap handle portion as a handle, with said first portion of said strap providing support for the tank.

8. A method of carrying a scuba tank having a nipple end and a bottom end and being of a specific size comprising snugly fitting a porous fabric bag that has an attached strap with a portion at least partially encircling the bag and a handle portion over the bottom end of the scuba tank, closing an opened end of the bag, carrying the bag and scuba tank combination by the handle portion of the strap with the partially encircling portion supporting the scuba tank, and folding the handle portion onto the bag and then binding the bag and scuba tank combination on a scuba tank harness, with the handle portions restrained from movement by being bound against the harness.

9. A method as claimed in claim 8 further comprising wearing the bag and scuba tank combination while scuba diving.

* * * * *